United States Patent [19]

Berger

[11] 4,357,950

[45] Nov. 9, 1982

[54] TOBACCO SMOKE FILTER HAVING IMPROVED TAR/CARBON MONOXIDE RATIO

[75] Inventor: Richard M. Berger, Midlothian, Va.

[73] Assignee: American Filtrona Corporation, Richmond, Va.

[21] Appl. No.: 153,560

[22] Filed: May 27, 1980

[51] Int. Cl.[3] ..... A24D 3/04; A24D 3/00

[52] U.S. Cl. ..... 131/338; 131/339; 131/340; 131/344; 131/332

[58] Field of Search ..... 131/336, 339, 332, 340, 131/344

[56] References Cited

U.S. PATENT DOCUMENTS

| | | | |
|---|---|---|---|
| 3,297,041 | 1/1967 | Sproull et al. | 131/339 |
| 3,389,705 | 6/1968 | Levavi | 131/339 |
| 3,496,945 | 2/1970 | Tomkin | 131/339 |
| 3,599,646 | 8/1971 | Berger | 131/339 |
| 3,637,447 | 1/1972 | Berger | 131/339 |
| 3,841,338 | 10/1974 | Horsewell et al. | 131/339 |
| 3,964,493 | 6/1976 | Baker | 131/339 |
| 4,046,063 | 9/1977 | Berger | 131/339 |
| 4,064,791 | 12/1971 | Berger | 131/339 |

FOREIGN PATENT DOCUMENTS

| | | | |
|---|---|---|---|
| 2018558 | 1/1971 | Fed. Rep. of Germany | 131/339 |
| 2849904 | 5/1979 | Fed. Rep. of Germany | 131/339 |
| 2383617 | 11/1978 | France | 131/339 |
| 1263154 | 2/1972 | United Kingdom | 131/339 |
| 1282132 | 7/1972 | United Kingdom | 131/339 |
| 1319862 | 6/1973 | United Kingdom | 131/339 |
| 1358685 | 7/1974 | United Kingdom | 131/339 |
| 1435255 | 5/1976 | United Kingdom | 131/339 |
| 2012554 | 11/1978 | United Kingdom | 131/339 |

*Primary Examiner*—V. Millin

*Attorney, Agent, or Firm*—Holman & Stern

[57] ABSTRACT

A tobacco smoke filter having an improved tar/carbon monoxide ratio is disclosed. The filter is obtained by sealing off the center portion of the filter with an inner member which is impermeable to the passage of smoke, thus directing all of the smoke to the periphery of the filter. In one embodiment, the inner member is formed as a thin walled tube of a material such as polypropylene, with the tube being crimped to seal one end of the tube. The crimped tube is then overwrapped with a smoke permeable material.

35 Claims, 23 Drawing Figures

TOBACCO SMOKE FILTER HAVING IMPROVED TAR/CARBON MONOXIDE RATIO

BACKGROUND AND SUMMARY OF THE INVENTION

The present invention relates to the production of filter means, and relates more particularly to tobacco smoke filter elements. More specifically, the instant inventive concepts are primarily concerned with producing filter means for cigarettes, although the products of this invention are generally useful as filters, particularly for tobacco smoking means, whether they be cigarettes, cigars, pipes or the like. Since filters for cigarettes are particularly commercially important, the basic embodiments of the instant invention will be discussed as they relate to the production of filtered cigarettes.

In making filters for use in connection with cigarettes and the like, a number of different properties of the resultant filter must be taken into consideration. While filtration efficiency, i.e., the ability of the filter to remove undesirable constituents from tobacco smoke, is perhaps the most important property of cigarette filters, filtration efficiency must frequently be compromised in order for the filter to possess a commercially acceptable combination of other properties, including pressure drop, taste, hardness, appearance and cost. For example, the most commonly utilized cellulose acetate filter has a relatively low filtration efficiency since increased efficiency can only be obtained either by increasing the density of the filter material or the length of the filter element, both of which produce a pressure drop across the filter which is excessive and unacceptable from a commercial standpoint.

In recent years, air dilution has become a popular technique for compensating for the relatively low filtration efficiency of cigarette filters having a sufficiently low pressure drop for commercial acceptance. The air dilution technique employs ventilating air to dilute the smoke stream from the cigarette and thereby reduce the quantity of tar and other undesirable tobacco smoke constituents drawn into the smoker's mouth for each puff or draw. The ventilating air is generally provided through a plurality of perforations in the tipping paper employed for joining the filter to the tobacco column of the cigarette, and if the filter is overwrapped with plugwrap paper, an air pervious plugwrap paper is employed.

The air dilution technique has several advantages in that it is the most economical method of reducing tar, it enables achievement of the exact amount of tar delivery desired, and it also contributes to the removal of undesirable gas phase constituents, such as CO and NO. Disadvantages of the air dilution technique include lack of taste and uneven staining of the filter. Also, even though air dilution is an excellent means of providing for vapor phase removal, there is a need for selectively removing CO in relation to the tar content.

Previous methods for removal of the vapor phase have included the method described in British Patent Application Ser. No. 2,012,554 published Aug. 1, 1979, wherein the filter surface area is reduced by placing a thick plastic coating over a small acetate rod.

By the present invention there is provided an improved cigarette filter or the like which reduces the carbon monoxide (CO) content in relation to tar below any of the currently employed dilution techniques, and also leaves a clean appearance at the end of the filter after the cigarette has been smoked, while at the same time enhancing the taste properties of the filter. The improved filter of the present invention is obtained by sealing off the center portion of the filter and directing all of the smoke to the periphery of the filter. The sealing of the center portion of the filter may be accomplsihed by extruding a thin wall tube of a material which is impermeable to smoke and crimping this tube so as to seal one portion for every filter tip. The crimped tube is then overwrapped with a smoke permeable material such as cellulose acetate tow. Air is then blended with the smoke rather than the conventional method wherein the air travels down the outside of the filter leaving the smoke to come in through the center. By directing all of the gas phase to the periphery of the filter, the gas phase is exposed to the air dilution holes, causing the loss of CO and other undesirable gases.

In the use of a crimped tube, the beneficial results obtained by directing the smoke to the periphery of the filter are obtained primarily in the uncrimped portion where the smoke is directed to the outer periphery of the filter, rather than in the crimped area where the outer smoke permeable member will have a relatively large cross-sectional area. Also the air dilution holes are located outwardly of the uncrimped portion of the smoke impermeable inner member, as shown in the examples described hereinafter.

In addition to directing the smoke to the periphery of the filter, the amount of surface area through which the smoke travels is reduced, thus reducing the filtration efficiency of the tar removal. It has been found that low filtration filters, in conjunction with the air dilution feature, deliver more taste at the same tar levels, provided the draw resistance can be maintained. The theory on which this is based is that unfiltered smoke offers more taste than filtered smoke. By reducing the filtration and blending the air with all of the smoke, the same weight of tar is achieved but with improved taste. In addition, this method of completely blending the smoke can be designed so that it will provide the filter with a clean appearance after smoking and so that, in any event, the staining will be uniform.

A most important feature of the present invention is that a tar/CO ratio of approximately 2 is achieved, compared to a ratio of 1 for conventional air diluted cigarettes which deliver from 5 to 10 mgs. of tar. An additional important feature of the present invention is that the present filter can be produced at a lower cost than conventional acetate filters.

Other advantages of the tobacco smoke filter of the present invention include the fact that different shaped tubes may be extruded in order to provide various shapes for the filter. By modifying the crimp, many unique end appearances for the filter can be achieved. Also, by modifying the process and using white tubing, for example, a conventional end appearance of the filter can be maintained. In addition, a thick sheet of filter material can be employed rather than the acetate tow, by use of the wrapped filter-making technique so that the crimped filter tube would be wrapped with a filter material.

An additional feature of the present invention is the use of a plug of acetate tow material to prevent the thin wall crimped tube from being shown at the end of the filter.

Another feature of the present invention is a progressive ventilation feature, wherein the thin walled tube is provided with a series of perforations around its periphery in order to obtain a more uniform amount of tar passing through the filter.

Yet another feature of the present invention is the use of a filter comprising a reconstituted tobacco member, wherein the tobacco member is hidden from being shown at the end of the filter by the use of a plug of acetate tow.

BRIEF DESCRIPTION OF THE DRAWINGS

The advantages and features of the present invention will be more fully understood from the following description of the preferred embodiments, taken in conjunction with the accompanying drawings, wherein.

DESCRIPTION OF THE PREFERRED EMBODIMENTS

Figure 1:
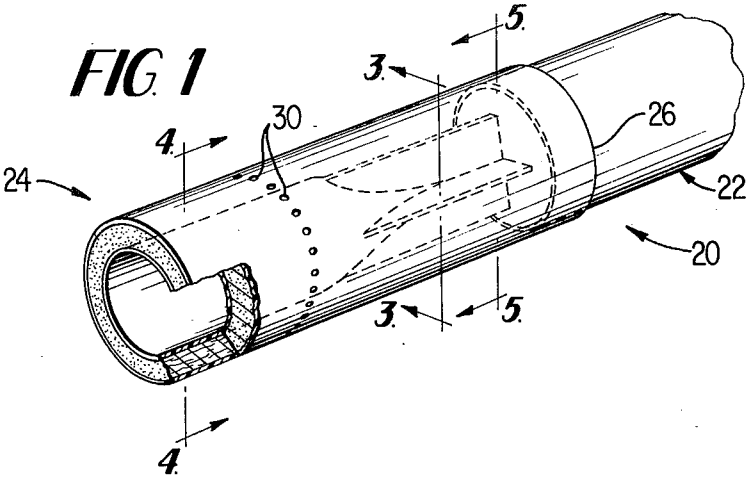
FIG. 1 is an enlarged perspective view of one form of cigarette produced according to the invention, with parts being broken away for illustrative clarity.

Referring now to the drawings, and more particularly to FIG. 1, a filtered cigarette according to the instant inventive concepts is designated generally by the reference numeral 20 and comprises basically a tobacco rod shown partially at 22 and a filter element according to one embodiment of this invention designated generally by the reference numeral 24, a conventional tipping overwrap being shown at 26 securing the tobacco rod and the filter element in end-to-end relationship according to well known prior art techniques. The tipping paper overwrap 26 is provided with a plurality of air dilution perforations 30 arranged circumferentially around the filter element 24 to permit ventilating air to be drawn through the filter element with each draw or puff of the cigarette.

Filter element 24 comprises basically an axially elongated, hollow, crimped inner member 28 and an axially elongated, hollow, outer member 32 which is uncrimped and provides a uniformly round periphery for attachment of the tipping overwrap 26.

Figure 4:
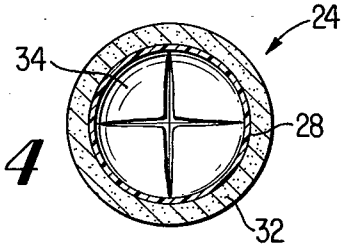
FIG. 4 is a transverse cross-sectional view through the filter element of the filtered cigarette of FIG. 1, taken along line 4—4 of FIG. 1.

The inner member 28 is formed of a material which is impermeable to the passage of smoke. Thus the material employed may be, for example, polypropylene, polyethylene or a similar material which does not allow smoke to pass through. The material employed for member 28 is preferably self-supporting in order to provide a suitable framework for the overwrap of outer member 32, as described hereinafter. While the inner member 28 is shown in FIG. 4 as having a cavity 34 formed therein, it is within the scope of the present invention to employ an inner member 28 which is of solid cross-section, without such a cavity 34, the primary requirement for inner member 28 being that it be formed of a material which is impermeable or non-porous to the passage of smoke so that the smoke is forced to pass through the outer member 32. In a preferred embodiment, the inner member 28 is formed by extruding a thin wall plastic tube of a material such as polypropylene, in accordance with well known methods, and crimping the tube thus formed so as to seal one end thereof as shown at 36 in FIG. 5.

The outer member 32 is preferably and primarily formed from a continuous tow of cellulose acetate filamentary material, although other filtering material may be used with slight modifications. For example, filamentary tow formed of other material such as polyethylene, polypropylene and the like or even non-woven staple fibers of the type described in some detail in U.S. Pat. Nos. 3,297,041 and 3,552,400 which are commonly assigned, the disclosures of which are incorporated herein by reference, may be used for the outer member 32. In fact, it is even possible to produce filter elements according to the present invention wherein the outer member 32 is produced from an extruded, open celled foamed material, such as cellulose acetate foam or the like. However, since cellulose acetate filamentary tow is the presently preferred material from a commercial standpoint, the remainder of this specification will be directed to the use of such material for the outer member 32.

Thus the outer member 32 is preferably formed of filamentary cellulose acetate members bonded together at their contact points to form smoke-permeable elements defining tortuous paths for passage of smoke therethrough. Filtering material of this nature is well known as are techniques for producing same.

As will be seen from FIG. 4, the outer surface of the inner member 28 is juxtaposed to the inner surface of the outer member 32. Since the inner member 28 is impermeable to the passage of smoke, all of the smoke is forced to travel through the outer member 32 and none of the smoke enters the internal cavity 34 of the inner member 28. The diameter of the inner member 28 relative to the overall diameter of the filter 24 determines the percentage of the surface area of the filter 24 which is exposed to smoke. Of course this will vary somewhat along the length of the filter 24, due to the crimped configuration of the inner member 28, except in cases when the outer tube is formed prior to inserting the inner tube (see FIGS. 14 and 22). It has been found, in accordance with the present invention, that the greater the diameter of the inner member 28, or correspondingly the thinner the cross-section of outer member 32, the higher will be the tar/CO ratio and the lower the filtration efficiency. Thus, for example, by the use of an inner member 28 having an outside diameter of about 6 mm, which corresponds to approximately $\frac{2}{3}$ the cross-sectional area of a standard cigarette filter, there have been obtained nearly ideal characteristics for manufacturing purposes when such an inner member 28 is used in combination with an outer member 32 of cellulose acetate tow material.

Figure 5:
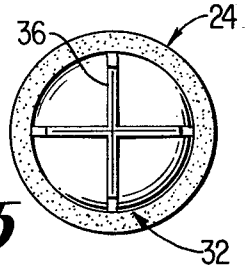
FIG. 5 is an end elevational view of the filter element of FIG. 1, taken along line 5—5 of FIG. 1.

While the filter means 24 has been shown in FIG. 1 as having the crimped portions 36 of the inner member 28 juxtaposed to the tobacco section 22 of the filtered cigarette, it is, of course, possible to reverse the filter means 24 so that the open area formed by the inner cavity is juxtaposed to the tobacco section 22, thus providing a mouth piece having a design such as shown, for example, in FIG. 5 or presenting any other crimped section at the mouth piece end of the filtered cigarette.

Figure 3:
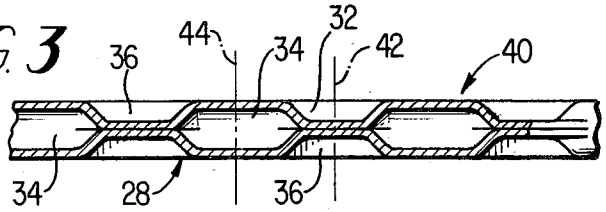
FIG. 3 is a fragmentary view in partial cross-section of a filter rod produced according to this invention, taken along line 3—3 of FIG. 1.

In FIG. 3 a continuous rod 40 made up of a multiplicity of integrally connected filter elements of the type shown at 24 in FIG. 1 will be seen. This rod is severed transversely along the lines 42,44 to produce individual filter elements such as shown at 24. Of course, the rod could be severed at other locations to produce filter elements of multiple length. Moreover, it is common practice to initially produce double filters which are then secured to two tobacco sections by a common tipping overwrap, following which individual filtered cigarettes are formed by severing the double filter at its midpoint.

In FIGS. 2 and 6 through 10, there is shown the overall method and means utilized in producing filter elements in accordance with the present invention. Basically, this overall technique is similar in many respects to the techniques described in detail in U.S. Pat. Nos. 3,637,447 and 4,046,063 both of which are incorporated herein by reference. According to preferred embodiments of this invention, as indicated above, the material utilized in the production of the inner member 28 of the filter elements is a continuous extrusion of thin walled plastic tubing, designated generally by the reference numeral 50, formed of a material such as polypropylene. The material 50 passes out of a conventional plastic extruder 52 where the tube shape is initially formed and then passes through a water and vacuum box 54 of conventional construction. Such thin walled plastic tubing 50 can be formed by any of the methods well known in the art which result in a continuous tube, the walls of which are impermeable to the passage of smoke.

Figure 6:
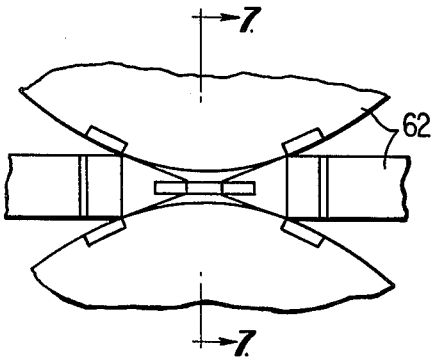
FIG. 6 is a fragmentary elevational view of the crimping means utilized in forming the inner member accordng to this invention.
Figure 7:
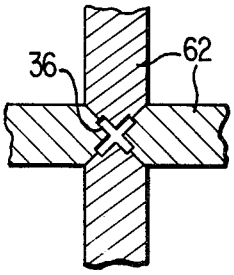
FIG. 7 is a sectional view taken along line 7—7 of FIG. 6.
Figure 8:
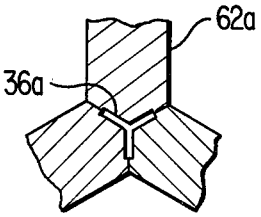
FIGS. 8 and 9 are alternative embodiments of the crimping wheel configuration shown in FIGS. 6 and 7.
Figure 9:
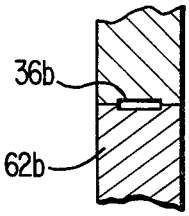
Figure 10:
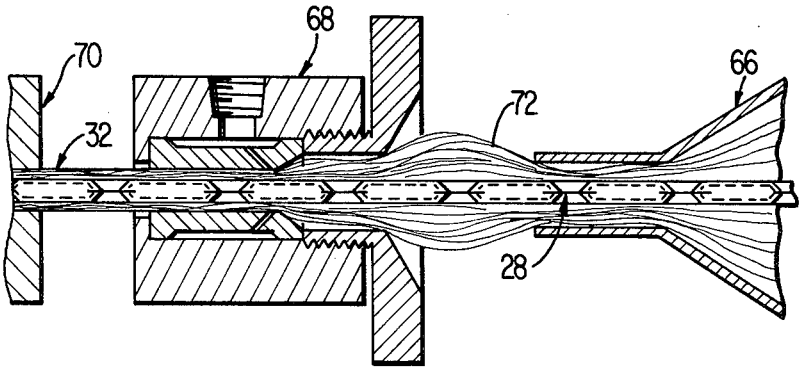
FIG. 10 is a fragmentary sectional view showing the manner in which the outer member of the filter element is formed.

The resultant thin-walled tube is crimped at 60 by a multiplicity of crimping wheels 62, portions of which are schematically shown in detail in FIGS. 6 and 7, to produce discrete, axially spaced, internal cavities 34 sealed at both ends by crimped portions 36 as shown in FIG. 3. Other alternative crimping wheel configurations **62*a*, 62*b* with corresponding crimped portions 36*a*, 36*b* are shown in FIGS. 8 and 9. Details of such crimping wheels will be seen, for example, in FIGS. 10–13** of U.S. Pat. No. 3,637,447.

The crimped tubing which is to form the inner members 28 passes out of the crimping area 60, being continuously pulled by garniture means 56, and passes into a conventional stuffer jet 66. Here the crimped inner member 28 functions as a mandrel, with the outer member 32 being formed about the inner member 28 from a filamentary tow material 72 during this portion of the processing as will be seen in detail in FIG. 10. As indicated previously, the filtering material utilized in the production of the outer member 32 of the filter elements is a continuous filamentary tow 72, which includes a multiplicity of bondable fibrous members activated by contact with a hot fluid, such as steam. The filtering tow material 72 is continuously passed into and through an elongated bonding zone, including a conventional stuffer jet 66, steam head 68 and cooling head 70, with the tow 72 being continuously pulled therethrough by garniture means 64. The tow 72 is contacted with steam in the steam head 68 to produce a smoke-permeable annular wall of bonded fibrous members formed about the inner member 28, with the resulting filter element formed by members 28 and 32 being rendered self-supporting as it is cooled by air or the like in the cooling head 70.

After exiting from the cooling head 70, the resultant two-layered rod is then severed transversely at selected locations in a cutting means as shown schematically at 76. Prior to passing into the cutting means 76, the two-layered rod may be overwrapped by a conventional plug wrap if desired. Since the rod is self-supporting, however, a separate plug wrap is not required. If a plug wrap is employed, an air permeable filter material should be used for this purpose, in order to retain the air dilution characteristics of the resulting filter.

While the use of acetate fibers to provide the outer member 32, as described previously, is the preferred method for covering the inner member 28, a thick sheet of filter material may be employed instead of the acetate fibers to cover or wrap the inner member 28. Such filter material employed for this purpose is a stiff material of the type used in the manufacture of cigarette mouth pieces and the wrapping of the crimped inner member 28 with such filter material can be carried out by the method as described in U.S. Pat. No. 3,599,646 which is incorporated herein by reference. If a sheet of filter material is employed rather than the acetate tow for the outer member 32, the limitation on the diameter of the inner member 28 would depend upon how thin a sheet could be used for the outer member 32 and still provide an acceptable pressure drop.

Figure 11:
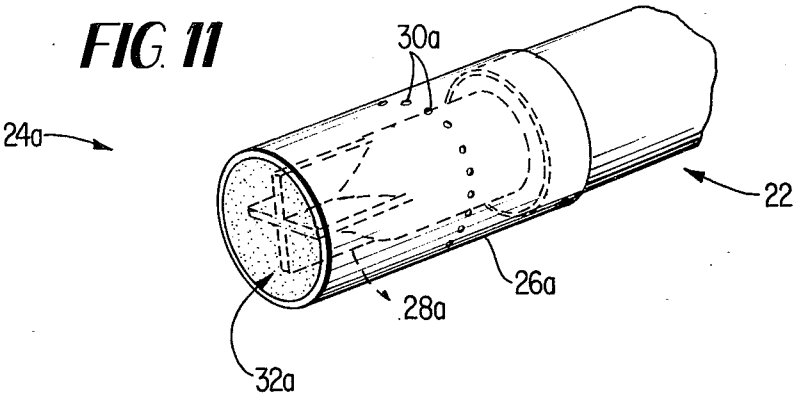
FIG. 11 is an enlarged perspective view of an alternative embodiment of the filter produced according to the present invention, with parts being broken away for purposes of clarity.
Figure 12:
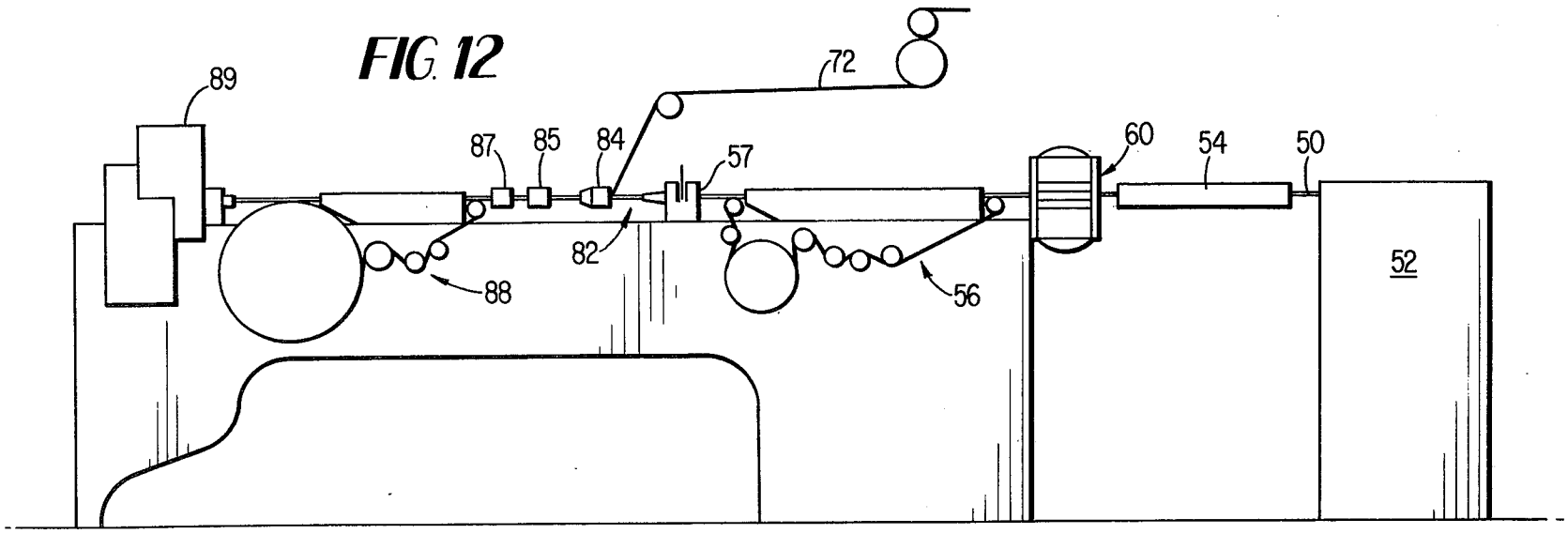
FIG. 12 is a schematic view of a method and means for making filter elements according to the embodiment of FIG. 11.

In an alternative embodiment, the filter 24*a* is produced so that the inner member 28*a* is hidden from the outer end of the filter 24*a* by a material which comprises the outer member 32*a*, as shown in FIG. 11. Such a filter 24*a* may be produced by the method as shown schematically in FIG. 12, which corresponds in many respects to the method as described in U.S. Pat. No. 4,064,791, incorporated herein by reference. In this alternative method, the thin walled plastic tubing 50 passes out of the extruder 52 and through the water and vacuum box 54 and the crimping assembly 60 as described previously in connection with the first embodiment. The crimped thin walled tube, being pulled continuously by garniture means 56, then passes into a cutter and feed tube assembly 57 where the tube 50 is transversely severed at axially spaced locations to form discrete inner members 28. The cutter and feed tube assembly 57, one form of which is shown in detail in FIG. 13, includes one or more radially, circumferentially spaced blades 80 which are rotatably supported as at 81 to transversely sever the tube 50. Jets of pressurized air or the like are employed in a spacing means 83 to axially separate the discrete members 28 as they pass into elongated tube 82, with the details of apparatus for this purpose being described in detail in U.S. Pat. No. 4,064,791.

Figure 14:
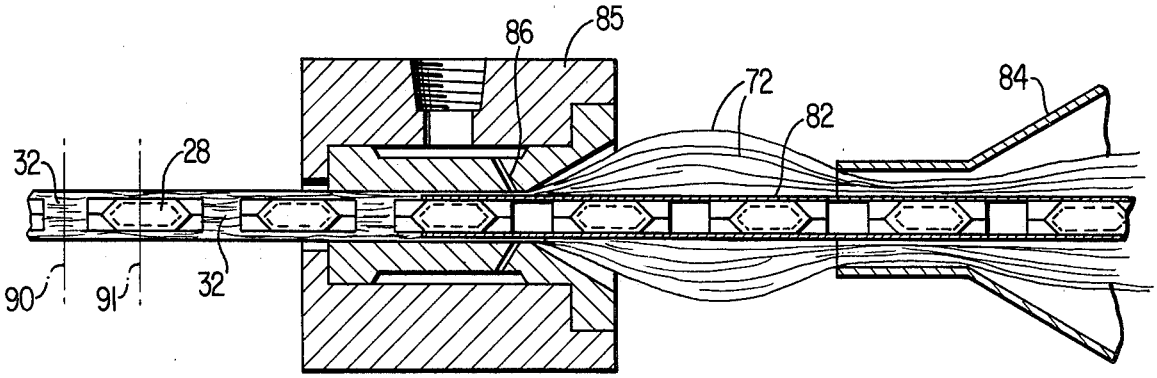
FIG. 14 is a fragmentary sectional view showing the manner in which the outer member of the embodiment of FIG. 11 is formed.

With the arrangement as described, the elongated tube 82 may be simultaneously utilized to provide a mandrel extending through a stuffer jet 84 and into a steam head 85, as shown in FIG. 14, to form an annular space for production of the outer member 32 from a filamentary tow material such as shown at 72. In order that the tow material 72 which forms the outer member 32 will also fill the axial spaces between inner members 28, the tube 82 should stop short of the steam head 85 so that the steam which contacts the filamentary tow 72 at points 86 will bond the fibers of the tow 72 located both circumferentially around the spaced inner members 28 as well as between these members 28. As will be seen in FIG. 14, the inner members 28 are thus deposited, in axially spaced relationship, into the internal bore of the outer member 32, and with portions of member 32 forming a solid wall of bonded filamentary material between discrete inner members 28. The composite rod formed of the outer and inner members then passes through a cooling head 87 and is continuously moved forwardly by a further garniture means 88, passing into a cutting means 89 where the rod is severed transversely at selected locations. By severing the rod at locations 90, 91 in FIG. 14, for example, a filter 24*a* will be obtained wherein the inner member 28*a* will be hidden within the filter and will not be visible on the exterior of the filter 24*a*, as shown in FIG. 11.

Figure 15:
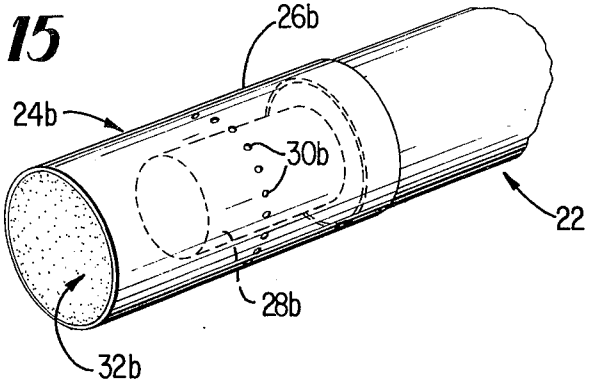
FIG. 15 is an enlarged perspective view of another alternative embodiment of the filter produced according to the present invention with parts being broken away for purposes of clarity.

In an embodiment which is somewhat related to that just previously described, a reconstituted tobacco member is employed as the inner member 28*b*, as shown in FIG. 15, and the inner member 28*b* is hidden within the filter 24*b* by a portion of outer member 32*b* so as not to be visible on the exterior of the filter 24*b*. The reconstituted tobacco member is formed from a coherent sheet of reconstituted tobacco which has been uniformly embossed with a series of parallel grooves, and then compacted and bonded into a self-sustaining dimensionally stable axially elongated body whose longitudinal axis extends parallel to the embossed grooves. A method of making the reconstituted tobacco member is described in detail in U.S. Patent Application Ser. No. 24,251 filed Mar. 27, 1979 and commonly owned with the present application, and the contents of Application Ser. No. 24,251 are incorporated herein by reference.

It is pointed out that the reconstituted tobacco member is permeable to smoke and thus, when such a tobacco material is employed for the inner member 28*b* as shown in FIG. 15, smoke will pass through both the inner 28*b* and outer 32*b* members of the filter 24*b*.

Figure 17:
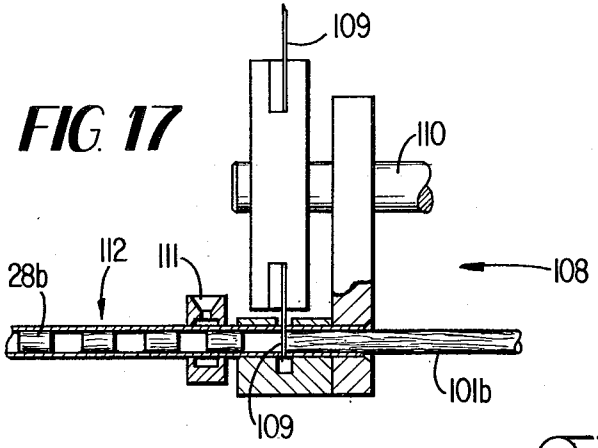
FIG. 17 is fragmentary sectional view showing means for severing the inner rod to form discrete inner members employed in the embodiment of FIG. 15.
Figure 16:
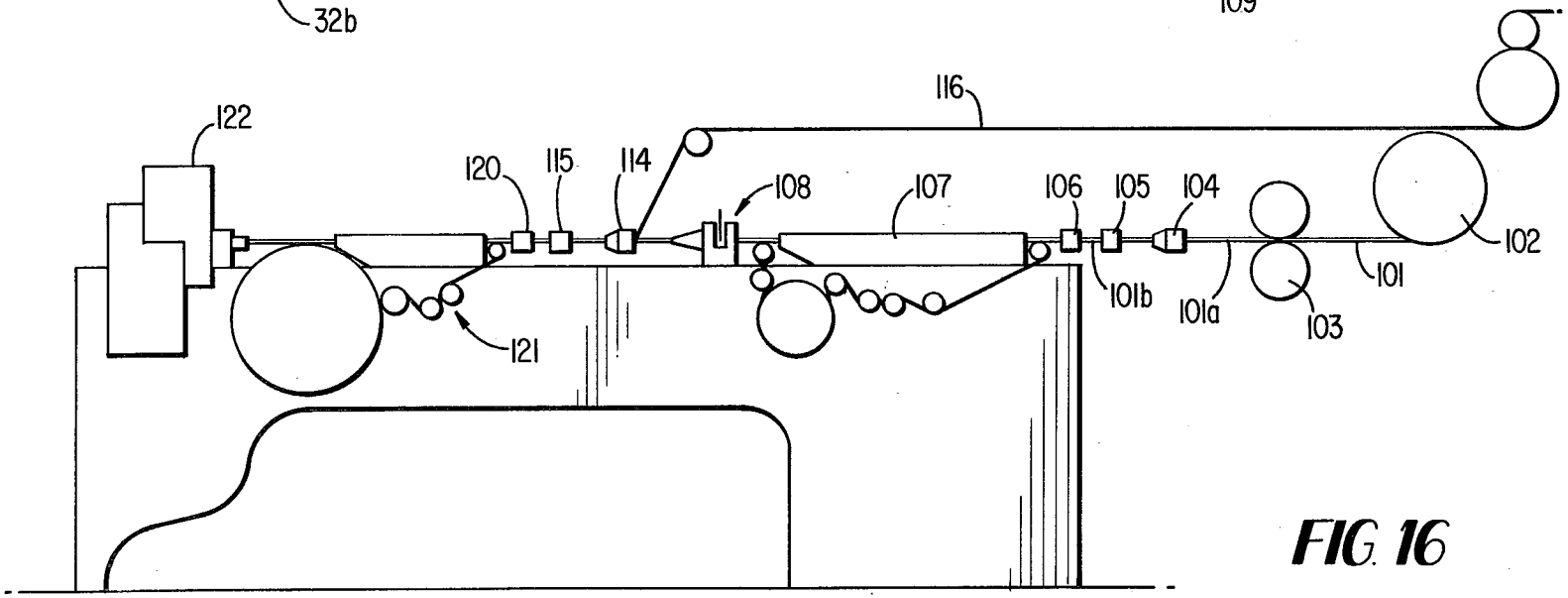
FIG. 16 is a schematic view of a method and means for making filter elements according to the embodiment of FIG. 15.
Figure 18:
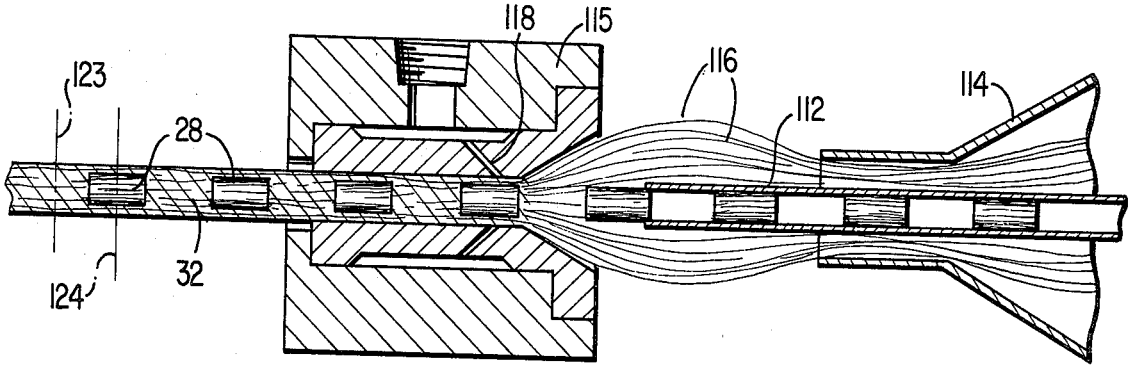
FIG. 18 is a fragmentary sectional view showing the manner in which the outer member of the embodiment of FIG. 15 is formed.

Referring to FIGS. 16, 17 and 18, a method and means for producing filter member 28*b* is shown. As shown schematically in FIG. 16, a continuous web 101 of reconstituted tobacco sheet, taken from a supply roll 102, is first passed through a pair of circumferentially grooved embossing wheels 103. The embossed web 101*a* emerging from the embossing rolls 103 has its surface uniformly embossed with a series of parallel longitudinally extending grooves. The embossed web is then passed through a feed funnel 104 wherein it becomes formed and compacted together into an axially elongated rod-like formation.

The compacted embossed web is then passed through a heat-bonding head 105 where, as the web passes through, it is subjected to heated gas treatment and thereby becomes heat-bonded into a self-sustaining axially elongated rod-like reconstituted tobacco body 101*b* shaped to its desired cross-section. The rod-like tobacco body 101*b* is then preferably passed through a conventional air-injecting cooling head 106 and thereafter through an elongated pulling device 107 provided with a longitudinally-extending passageway having a cross-sectional size and shape substantially equal to that of the reconstituted tobacco body 101*b* in order to hold it in such size and shape for a period sufficient to ensure that its dimensional stability will be maintained in the subsequent processing stations.

Figure 13:
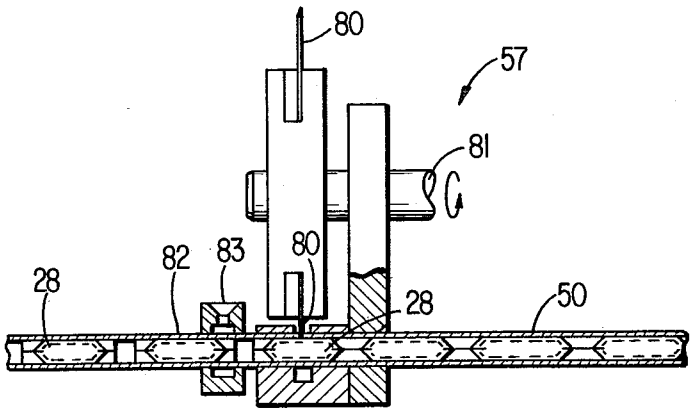
FIG. 13 is a fragmentary sectional view showing means for severing the inner rod to form discrete inner members employed in the embodiment of FIG. 11.

The rod 101*b* is next passed into a cutter and feed tube assembly 108, shown in detail in FIG. 17 and being of the type previously described in connection with FIG. 13. Thus the assembly 108 includes a plurality of cutting blades 109 which are rotatably supported at 110 to transversely sever the rod 101*b*. Spacing means 111 is employed to axially separate the severed discrete members 28*b* as they pass into an elongated tube 112.

The remainder of the apparatus and method of forming the filter member 24*b* is similar to that described previously in connection with FIG. 12, with the tube 112 functioning as a mandrel extending through a stuffer jet 114 and into a steam head 115, as shown in FIG. 18, to form an annular space for production of the outer member 32*b* from a filamentary tow material such as shown at 116. Here again, as in connection with the embodiment of FIG. 14 previously discussed, the tube 112 should stop short of the steam head 115 so that the steam which contacts the filamentary tow 116 at points 118 will bond the fibers of the tow 116 located both circumferentially around the spaced inner members 28 as well as between these members 28. As seen in FIG. 18, the inner members 28 are thus deposited, in axially spaced relationship, into the internal bore of outer member 32, and with portions of member 32 forming a solid wall of bonded filamentary material between successive discrete inner members 28.

The composite rod formed of the outer and inner members then passes through a cooling head 120 and is continuously moved forwardly by a garniture means 121, passing into a cutting means 122 where the rod is severed transversely at selected locations. By severing the rod at locations 123, 124 in FIG. 18, for example, a filter 24*b* will be obtained wherein the inner member 24*b*, formed of reconstituted tobacco, will be hidden within the filter and will not be visible on the exterior of the filter 24*b*, as shown in FIG. 15.

In the embodiments of FIGS. 11, and 15, the length of the inner member 28 should be at least approximately 20% the length of the outer member 32 so that the desired effect of the use of an inner member 28 which is impermeable to the passage of smoke will be obtained.

Figure 19:
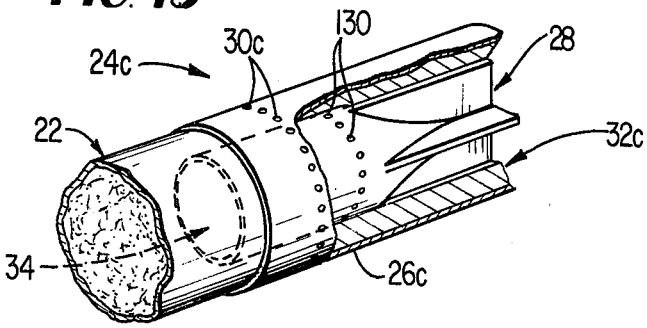
FIG. 19 is an enlarged perspective view of another alternative embodiment of the filter produced according to the present invention, with parts being broken away for purposes of clarity.

In another alternative embodiment, the inner member 28*c* is provided with a series of perforations or holes 130 around the periphery of the uncrimped portion, just ahead of the crimped portion of the member 28*c*, as shown in FIG. 19. Such a configuration contributes to provide constant tar delivery from puff to puff. Thus, as smoke passes through the holes 130 into the cavity 34 during initial puffs, greater amounts of tar, with a corresponding improved taste, are allowed to pass through. During later puffs, however, the outer tow material 32 tends to fill up or clog the holes 130, thus preventing smoke from passing through into the cavity 34 so that all the smoke must pass through the outer member 32.

Figure 2:
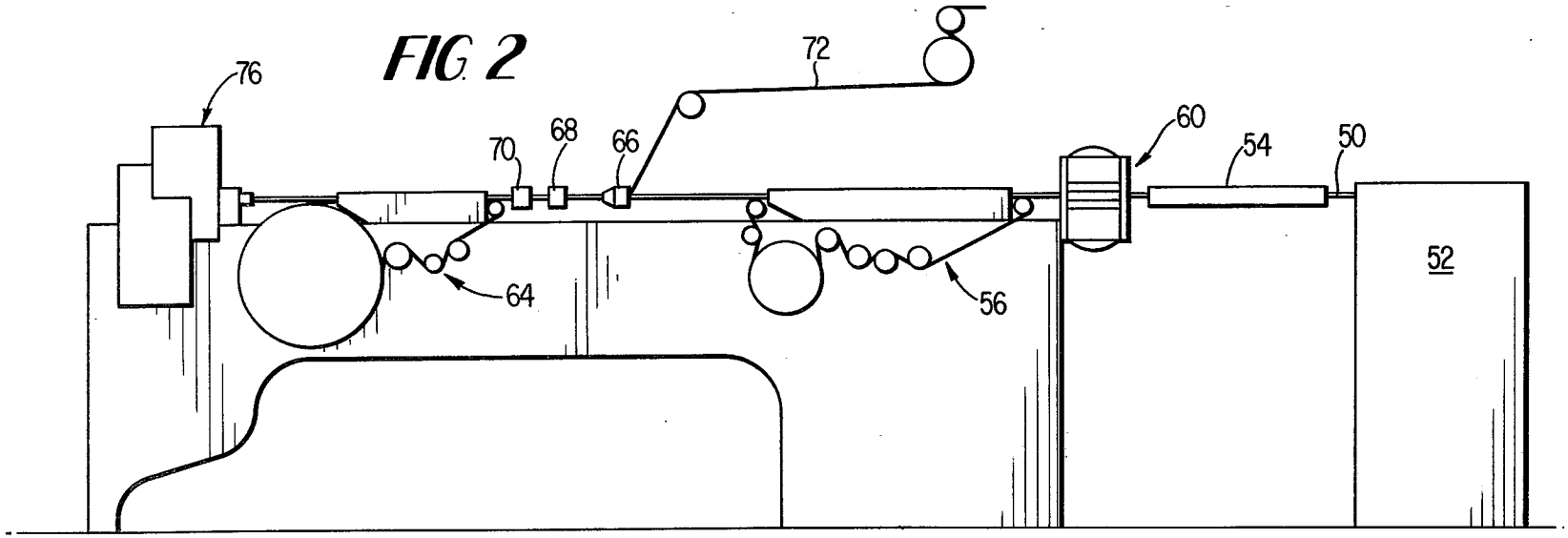
FIG. 2 is a schematic view of a method and means for making filter elements according to the instant inventive concepts.
Figure 21:
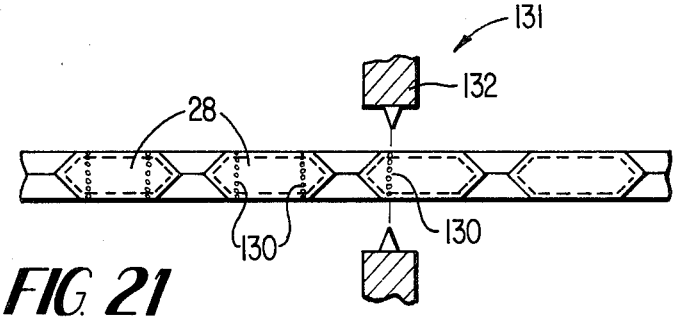
FIG. 21 is a fragmentary sectional view showing means for providing perforations around the periphery of the inner members employed in the embodiment of FIG. 19.
Figure 20:
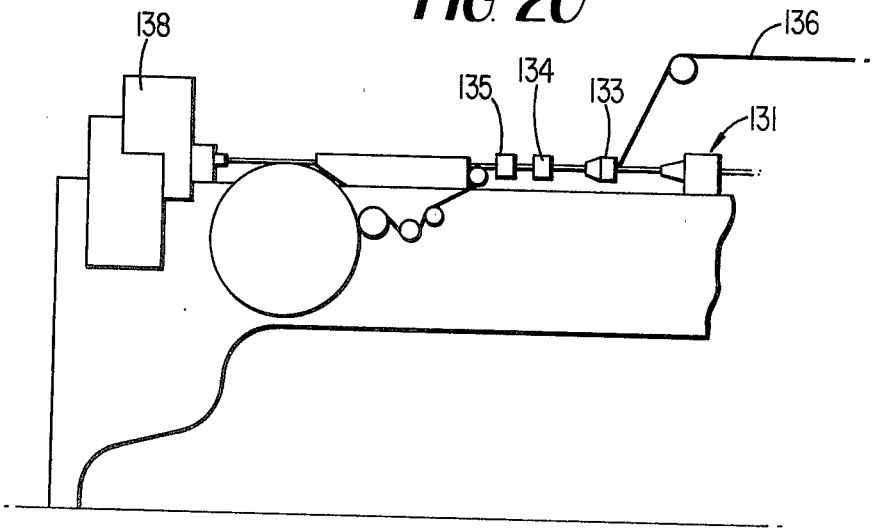
FIG. 20 is a schematic view of a method and means for making filter elements according to the embodiment of FIG. 19.

A method and apparatus for production of the filter 24*c* of FIG. 19 is partially shown in FIG. 20, with the portion of the apparatus which includes the plastic extruder, the water and vacuum box, the crimper and the first garniture means being the same as shown in the embodiment of FIG. 2 and thus not being shown in FIG. 20. The first garniture means passes the crimped inner member 28 into a laser assembly 131, shown schematically at FIG. 21, wherein a laser device 132 is employed in a conventional manner to make a series of small holes or perforations 130 on the end of the inner members 28. Any other conventional means may be employed in a similar manner to perforate the inner member 28 around the periphery thereof.

Figure 22:
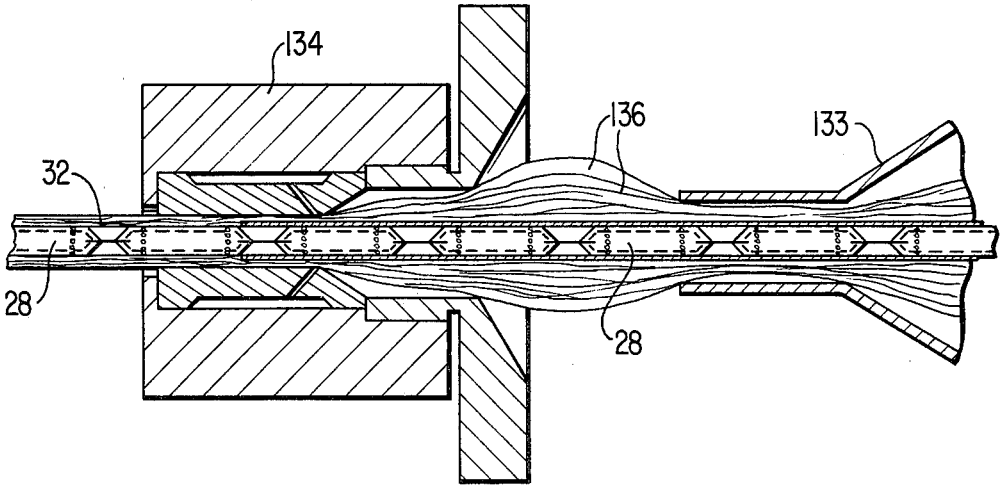
FIG. 22 is a fragmentary sectional view showing the manner in which the outer member of the embodiment of FIG. 19 is formed.

From the perforating laser assembly 131, the crimped tubing which is to form the inner members 28 passes into a conventional stuffer jet 133, steam head 134 and cooling head 135, wherein the formation of the outer member 32 about the inner member 28 is similar to the embodiment of FIG. 2 previously described. Thus the filtering tow material 136 which is to form the outer members 32 continuously passes into the bonding zone and is contacted with steam in the steam head 134, as described previously in connection with FIG. 2, to produce a smoke-permeable annular wall of bonded fibrous members formed about the inner member 28, as shown in FIG. 22. The resulting filter element formed by members 28 and 32 is then cooled in the cooling head 135 and is passed by garniture means 137 into the cutting means 138 to be severed at selected locations.

One advantage of the use of the filter of the present invention is the reduced weight of the filter. Thus, in the embodiment of FIG. 1, for example, by using as the inner member 28 a thin walled plastic tube having a 5 mil wall thickness, the weight reduction is approximately 30% compared to the use of acetate tow material in an equal volume, i.e., 50% of the volume of the filter is replaced with a polypropylene tube weighing 30% less than the acetate which was removed. An additional advantage is the savings in production costs, due to the use of less expensive polypropylene as compared to the more expensive acetate material.

The following Table I test data on tar/CO ratios obtained for the filter of the present invention as illustrated in FIG. 1, as compared to two known commercial cigarettes.

TABLE 1

| | | Tar | CO | Tar/CO Ratio |
|---|---|---|---|---|
| Control 1: | Commercial Brand | 5.3 mgs. | 5.8 mgs. | .9 |
| | Commercial Brand | 4.0 mgs. | 4.5 mgs. | .9 |
| Control 2: | Commercial Brand | 7.3 mgs. | 7.0 mgs. | 1.0 |
| | Commercial Brand | 7.5 mgs. | 6.8 mgs. | 1.1 |
| C O D Filter[1] | | 12 mgs. | 5.9 mgs. | 2.0 |
| C O D Filter | | 8.5 mgs. | 4.0 mgs. | 2.1 |
| C O D Filter | | 6.5 mgs. | 3.0 mgs. | 2.2 |
| C O D Filter | | 8.1 mgs. | 3.7 mgs. | 2.2 |

Note:
[1]The C O D filter is the filter of the present invention as shown in FIG. 1, using one strand of 12/48 tow material formed over a 6 mm O.D. plastic tube.

The data of Table I illustrate the significant improvement in the tar/CO ratios of the filter of the present invention.

Table II below shows the effects of tube diameter on the tar/CO ratio and filtration efficiency, employing a filter in accordance with FIG. 1.

TABLE II

| Filter Diameter | Material | Tar/CO Ratio | Filtration Efficiency |
|---|---|---|---|
| 8 mm | 12/48 acetate tow, 6 mm O.D. plastic tube | 2.1 | 41% |
| 8 mm | 12/48 acetate tow, 4.8 mm O.D. plastic tube | 1.8 | 46% |
| 8 mm | 8/35 acetate tow, 6 mm O.D. plastic tube | 2.0 | 45% |
| 8 mm | 8/35 acetate tow, 4.1 mm O.D. plastic tube | 1.8 | 58% |

In the use of the filter of FIG. 19 with the preforated inner tube member, as previously described, Table III shows data obtained on tar/CO ratios for such filters as compared to a known commercial cigarette.

TABLE III

| COMMERCIAL BRAND | | | C O D[1] | | | |
|---|---|---|---|---|---|---|
| | Tip P.D., in. | Mgs. Tar | Tip P.D.,in. | Mgs. Tar | Mgs.CO | Tar/CO Ratio |
| Before | 4.1 | — | 3.2 | — | — | — |
| 1st Puff | 4.2 | .5 | 3.5 | .6 | .22 | 2.7 |
| 2nd Puff | 4.2 | .8 | 4.2 | .7 | .20 | 3.5 |
| 3rd Puff | 4.5 | .9 | 5.6 | .8 | .22 | 3.6 |
| 4th Puff | 4.7 | 1.0 | 5.7 | .6 | .23 | 2.6 |
| 5th Puff | 4.6 | 1.5 | 5.3 | .3 | .27 | 1.1 |
| 6th Puff | 4.7 | 1.7 | 6.0 | .7 | .29 | 2.4 |
| 7th Puff | | | 5.9 | .5 | .20 | 2.5 |

Note:
[1]The C O D filter is the filter of the present invention as shown in FIG. 19, with 12/48 acetate tow for the outer member and a 6 mm O.D. plastic tube with four 0.020 inch diameter holes for the inner member.

Figure 23:
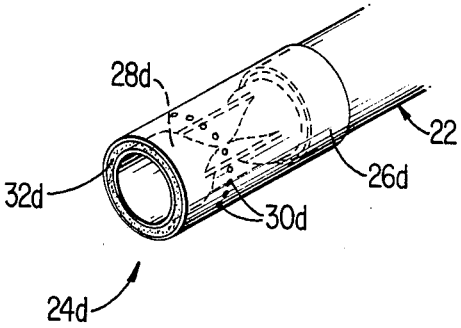
FIG. 23 is an enlarged perspective view of another alternative embodiment of the filter of the present invention.

In FIG. 23, there is shown an alternative embodiment wherein the inner member 28*d* of the filter element 24*d* is open at both ends and crimped in the mid-portion of the length thereof. The filter element 24*d* of this embodiment may be manufactured by a method such as described previously in connection with the embodiment of FIG. 1, with the exception that the element 24*d* is cut at locations such as to place the crimped portion of inner member 28d at the mid-point of the length of the filter element 24d. Table IV shows data obtained on tar/CO ratios for such filters as compared to known commercial cigarettes.

TABLE IV

| | Tar | CO | Tar/CO Ratio |
|---|---|---|---|
| Control 1: | 5.3 mgs. | 5.8 mgs. | .9 |
| Control 1: | 4.0 mgs. | 4.5 mgs. | .9 |
| Control 2: | 7.3 mgs. | 7.0 mgs. | 1.0 |
| Control 2: | 7.5 mgs. | 6.8 mgs. | 1.1 |
| COD II[1] | 7.8 mgs. | 2.5 mgs. | 3.1 |
| COD II[1] | 6.7 mgs. | 2.2 mgs. | 3.1 |

Note:
The COD II filter is the filter of the present invention as shown in FIG. 23.

It is thought that the invention and many of its attendant advantages will be understood from the foregoing description, and it will be apparent that various changes may be made in the form, construction and arrangement of the parts without departing from the spirit and scope of the invention or sacrificing its material advantages, the forms hereinbefore described being merely preferred embodiments thereof.

The embodiments of the invention in which an exclusive property or privilege is claimed are defined as follows:

1. Filtering means for filtering undesirable constituents from smoke comprising a filter element including:

(a) an axially elongated outer member having an axial passage therein, said outer member consisting essentially of a filtering material and having a smoke receiving end spaced from a smoke discharging end;

(b) sealing means for sealing off the passage to substantially prevent the axial movement of smoke through said passage and for directing the smoke entering at the smoke receiving end to pass through the filtering material of the outer member, said sealing means comprising an axially elongated inner member of smoke impermeable material coaxially disposed in relation to said outer member within said axial passage to substantially preclude the axial movement of smoke between the outer surface of said inner member and the inner surface of said outer member, said inner member being co-extensive with said axial passage; and (c) wrapping means for retaining smoke within the filtering material of the outer member as it is drawn from the smoke receiving end to the smoke discharging end, said wrapping means comprising an outer wrap disposed on the outer surface of said outer member.

2. The filter element of claim 1 wherein said filter material comprises a multiplicity of fibrous elements bonded together at their points of contact to define smoke-permeable members each providing a tortuous path for passage of smoke therethrough.

3. The filter element of claim 2 wherein said filter material comprises cellulose acetate tow.

4. The filter element of claim 1 wherein said outer wrap comprises a filter overwrap in sheet form.

5. The filter element of claim 1 wherein said tube is formed of polypropylene.

6. A smoke filter means including a filter element comprising:

(a) an axially elongated, hollow outer member;

(b) an axially elongated inner member disposed within said outer member;

(c) said outer member comprising a filtering material and including an inner surface and an outer surface and having spaced end portions;

(d) said inner member comprising a self-sustaining dimensionally stable reconstituted tobacco member in the form of a rod-like body comprising a coherent sheet of reconstituted tobacco compacted and bonded together;

(e) said inner member including an outer surface and having spaced end portions, one end portion being shorter than the corresponding end of said outer member to define cavity means within said outer member and wherein said cavity is filled with the filtering material of said outer member so that said inner member is not visible at the corresponding end of said filter element;

(f) said outer surface of said inner member being juxtaposed to said inner surface of said outer member to at least substantially preclude axial passage of smoke across the area therebetween.

7. A filtered cigarette comprising a tobacco rod and filtering means for filtering undesirable constituents from the tobacco smoke and for obtaining an improved tar/CO ratio, said filtering means comprising a filter element including:

(a) an axially elongated outer member having an axial passage therein, said outer member consisting essentially of a filtering material and having a smoke receiving end spaced from a smoke discharging end;

(b) sealing means for sealing off the passage to substantially prevent the axial movement of smoke through said passage and for directing the smoke entering at the smoke receiving end to pass through the filtering material of the outer member, said sealing means comprising an axially elongated inner member of smoke impermeable material coaxially disposed in relation to said outer member within said axial passage to substantially preclude the axial movement of smoke between the outer surface of said inner member and the inner surface of said outer member, said inner member being co-extensive with said axial passage; and (c) wrapping means for retaining smoke within the filtering material of the outer member as it is drawn from the smoke receiving end to the smoke discharging end, said wrapping means comprising an outer wrap disposed on the outer surface of said outer member.

8. The invention of claims 1 or 7, wherein said inner member is a solid core.

9. The filter element of claim 6 wherein said sheet of reconstituted tobacco is uniformly embossed with a series of parallel grooves extending longitudinally with respect to said reconstituted tobacco member so as to provide said reconstituted tobacco member with flow passages having a high surface area for contact with smoke passing therethrough, and thereby enabling said smoke to become tobacco flavor-enriched by extracting tobacco flavor from the reconstituted tobacco.

10. A filtered cigarette comprising, in combination, a tobacco rod and a filter means secured in end-to-end relationship to one end of said tobacco rod, said filter means including a filter element as defined in claim 6.

11. The invention of claim 1 or 7, wherein said outer wrap comprises a hollow cylinder of tipping paper disposed around the outer member of the filter element for securing the filter element to the tobacco rod, said tipping paper including a plurality of perforations for admitting ambient air into the filter material of the outer member so that smoke being drawn through the filter material is admixed with air.

12. A filter rod comprising a plurality of filter elements each including:

(a) an axially elongated outer member having an axial passage therein, said outer member comprising a filtering material and having a smoke receiving end spaced from a smoke discharging end; and (b) sealing means for sealing off the passage to prevent the axial movement of smoke from the smoke receiving end through said passage to said smoke discharging end and for directing the smoke entering said smoke receiving end to pass through the filtering material of the outer member, said sealing means comprising an axially elongated inner member of smoke impermeable material disposed within said passage to substantially preclude the axial movement of smoke between the outer surface of said inner member and the inner surface of said outer member, said inner member being co-extensive with said axial passage; and said filter elements being integrally connected so that the smoke receiving ends of alternating filter elements in said rod are juxtaposed to each other and the smoke discharging ends of alternating filter elements in said rod are juxtaposed to each other.

13. An axially elongated smoke filter element, said filter element having a smoke receiving end for receiving smoke from a tobacco rod and a smoke discharging end for discharging this smoke, and comprising (a) an axially elongated outer member consisting essentially of a filtering material and having an axial passage therein;

(b) an axially elongated hollow inner member of smoke impermeable material having an inner surface defining an internal cavity and an outer surface, said inner member being sealed at one end thereof and open at the other end thereof and coaxially disposed in relation to said outer member within said axial passage to substantially preclude the axial movement of smoke between the outer surface of the inner member and the inner surface of the outer member;

(c) regulating means for regulating the filtration of smoke passing through said filter element comprising passage means through said inner member providing direct communication between said inner and outer surfaces of said inner member to permit passage of a limited amount of smoke directly through said inner member, said passage means being partially occluded by the filtering material of said outer member as said filter element is used, to reduce the amount of smoke passing directly through said inner member with subsequent puffs and force more of such smoke through the filtering material of said outer member; and (d) wrapping means for retaining smoke within the filtering material of the outer member as it is drawn from the smoke receiving end of the filter element to the smoke discharging end.

14. The invention of claim 1, wherein the filtering element of the filtering means is secured in end-to-end relationship with a tobacco rod to form a filtered cigarette.

15. A filter rod comprising a multiplicity of filter elements as defined in claim 14 integrally connected together with first portions of alternating filter elements in said rod juxtaposed to each other and second portions of alternating filter elements in said rod juxtaposed to each other.

16. Filtering means for filtering undesirable constituents from smoke comprising a filter element including:

(a) an axially elongated outer member having an axial passage therein, said outer member consisting essentially of a filtering material and having a smoke receiving end spaced from a smoke discharging end;

(b) sealing means for sealing off the passage to substantially prevent the axial movement of smoke through said passage and for directing the smoke entering at the smoke receiving end to pass through the filtering material of the outer member, said sealing means comprising an axially elongated inner member of smoke impermeable material less than co-extensive with said axial passage and disposed within said axial passage to substantially preclude the axial movement of smoke between the outer surface of said inner member and the inner surface of said outer member and to leave a forward portion of the passage at the smoke discharging end of the outer member vacant;

(c) a plug of filtering material disposed against said inner member within the vacant forward portion of said axial passage so that the plug and inner member are co-extensive with said axial passage; and (d) wrapping means for retaining smoke within the filtering material of the outer member as it is drawn from the smoke receiving end to the smoke discharging end, said wrapping means comprising an outer wrap disposed on the outer surface of said outer member.

17. Filtering means for filtering undesirable constituents from smoke comprising a filter element including:

(a) an axially elongated outer member having an axial passage therein, said outer member consisting essentially of a filtering material and having a smoke receiving end spaced from a smoke discharging end;

(b) sealing means for sealing off the passage to substantially prevent the axial movement of smoke through said passage and for directing the smoke entering at the smoke receiving end to pass through the filtering material of the outer member, said sealing means comprising an axially elongated inner member of smoke impermeable material coaxially disposed in relation to said outer member within said axial passage to substantially preclude the axial movement of smoke between the outer surface of said inner member and the inner surface of said outer member, said inner member being substantially co-extensive with said axial passage and comprising a tube having one end crimped and sealed together; and (c) wrapping means for retaining smoke within the filtering material of the outer member as it is drawn from the smoke receiving end to the smoke discharging end, said wrapping means comprising an outer wrap disposed on the outer surface of said outer member.

18. A filtered cigarette comprising a tobacco rod and filtering means for filtering undesirable constituents from the tobacco smoke and for obtaining an improved tar/CO ratio, said filtering means comprising a filter element including:

(a) an axially elongated outer member having an axial passage therein, said outer member consisting essentially of a filtering material and having a smoke receiving end spaced from a smoke discharging end;

(b) sealing means for sealing off the passage to substantially prevent the axial movement of smoke through said passage and for directing the smoke entering at the smoke receiving end to pass through the filtering material of the outer member, said sealing means comprising an axially elongated inner member of smoke impermeable material coaxially disposed in relation to said outer member within said axial passage to substantially preclude the axial movement of smoke between the outer surface of said inner member and the inner surface of said outer member, said inner member being substantially co-extensive with said axial passage and comprising a tube having one end crimped and sealed together; and (c) wrapping means for retaining smoke within the filtering material of the outer member as it is drawn from the smoke receiving end to the smoke discharging end, said wrapping means comprising an outer wrap disposed on the outer surface of said outer member.

19. The invention of claim 12, wherein the inner member of each filter element comprises a tube crimped at one end, and wherein the crimped portions of alternating filter elements are juxtaposed and the open portions of alternating filter elements are juxtaposed in the filter rod.

20. The invention of claims 1, 7, 8, or 14, wherein the axial passage communicates with the ambient atmosphere at the smoke discharging end of the outer member.

21. The invention of claims 1, 7, 8, or 14, wherein the axial passage extends through said outer member.

22. The invention of claim 13, wherein the wrapping means comprises a hollow cylinder of tipping paper disposed around the outer member of the filter element for securing the filter element to the tobacco rod, said tipping paper including a plurality of perforations for admitting ambient air into the filter material of the outer member so that smoke being drawn through the filter material is admixed with air.

23. The invention of claim 13, wherein the filter element is secured in end-to-end relationship with a tobacco rod to form a filtered cigarette.

24. The invention of claim 13, wherein the sealed end of the hollow inner member is also crimped.

25. The invention of claims 13 or 24, wherein said passage means comprise a plurality of radially-disposed perforations in said hollow inner member.

26. The invention of claim 16, wherein said tube includes a plurality of perforations on the uncrimped portion thereof to permit smoke to radially enter the tube.

27. The invention of claim 24, wherein said passage means comprise a plurality of radially-disposed perforations in said hollow inner member toward the crimped portion thereof, and said crimped portion is disposed toward the smoke receiving end of said filter element.

28. The invention of claim 27, wherein said perforations are sized such that occlusion by said filtering material of said outer member increasingly restricts the passage of smoke to regulate the tar discharged at the discharging end of the filter element to a relatively constant level from puff to puff.

29. The invention of claim 19, wherein the open portions of the inner member of each filter element include a plurality of perforations.

30. The invention of claims 16, 5, or 28, wherein the crimped end of said tube is disposed at the smoke receiving end of said axial passage.

31. The invention of claims 16, 5, 28, or 18, wherein the crimped end of said tube is disposed at the smoke discharging end of said axial passage.

32. The invention of claim 18, wherein said tube includes a plurality of perforations on the uncrimped portion thereof to permit smoke to radially enter the tube.

33. The invention of claims 18 or 32, wherein the crimped end of said tube is disposed at the smoke receiving end of said axial passage.

34. The invention of claims 16 or 18, wherein said inner member comprises a tube crimped and sealed at the mid-portion thereof.

35. The invention of claim 18, wherein said filter material comprises cellulose acetate tow and wherein the cross-sectional area of said tube is about $\frac{2}{3}$ of the cross-sectional area of said filter element.

* * * * *